US005557163A

United States Patent [19]

Wakalopulos

[11] Patent Number: 5,557,163

[45] Date of Patent: Sep. 17, 1996

[54] MULTIPLE WINDOW ELECTRON GUN PROVIDING REDUNDANT SCAN PATHS FOR AN ELECTRON BEAM

[75] Inventor: George Wakalopulos, Pacific Palisades, Calif.

[73] Assignee: American International Technologies, Inc., Torrance, Calif.

[21] Appl. No.: 278,804

[22] Filed: Jul. 22, 1994

[51] Int. Cl.[6] ..... H01J 33/04

[52] U.S. Cl. ..... 313/420

[58] Field of Search ..... 313/420

[56] References Cited

U.S. PATENT DOCUMENTS

| | | | |
|---|---|---|---|
| 2,990,493 | 12/1957 | Seehof et al. | 313/420 |
| 3,611,418 | 10/1971 | Uno et al. . | |
| 3,788,892 | 1/1974 | Van Raalte et al. | 313/420 |
| 4,455,561 | 6/1984 | Boyden et al. | 313/420 |
| 4,468,282 | 8/1984 | Neukermans . | |
| 4,494,036 | 1/1985 | Neukermans | 313/420 |
| 4,721,967 | 1/1988 | Roche | 313/420 |

*Primary Examiner*—Sandra L. O'Shea
*Assistant Examiner*—Vip Patel
*Attorney, Agent, or Firm*—Schneck & McHugh

[57] ABSTRACT

An electron beam device having a plurality of individual, electron permeable, gas impermeable windows can produce a broad beam of free electrons. A multiplicity of windows allows each of the windows to be stronger, yet thinner, for greater electron permeability and durability. Having multiple windows also allows each window to be formed as a single crystal film, which can have superior strength and electron permeability, and which is difficult to form in a large area and easy to damage when so formed. In addition, having multiple windows allows a window end of the device and the beam which exits from that end to have configurations not easily achieved with a single window. Should a pinhole develop in one of the windows, it may be possible to seal the pinhole and re-evacuate the device, thereby extending the lifetime of the device. A current monitor is used to determine whether the electron beam passes through the windows or is absorbed in a surrounding face plate. A microprocessor controls the intensity and direction of the beam, in combination with feedback from the current monitor, to direct the beam through the windows in a sequence.

19 Claims, 3 Drawing Sheets

MULTIPLE WINDOW ELECTRON GUN PROVIDING REDUNDANT SCAN PATHS FOR AN ELECTRON BEAM

TECHNICAL FIELD

The present invention relates to electron beam devices, particularly electron beam devices having a wide beam.

BACKGROUND ART

Electron beam devices are known in which electrons are generated and accelerated in a vacuum tube to traverse a thin window for use outside the vacuum tube.

While a vacuum environment is beneficial for generating and accelerating electrons, it is also desirable that an electron window be thin to allow electrons to penetrate the window with minimal energy loss. The energy lost by an electron penetrating a window may be gained by the window as heat and in destruction of chemical bonds of the window material. The combined factors of a minimization of window thickness effected to enhance electron penetration of the window, a large pressure difference felt by the window due to the vacuum environment within the tube, and the destruction and heating caused by electrons penetrating the window can result in small holes or defects in the window that destroy the vacuum and wreck the tube.

For some applications, it is desirable to produce a broad beam of electrons. A challenge in producing such a device is that increasing the area of an electron window generally reduces the ability of that window to withstand large pressure differences.

An approach to solving this dilemma is to use materials in the window that are tough yet permeable to electrons, as taught by U.S. Pat. No. 4,468,282 to Neukermans. Neukermans teaches using polycrystalline substrates to grow long thin windows for printing applications.

In U.S. Pat. No. 3,788,892, Van Raalte et al. teach of producing a window across a long, narrow opening of an envelope and supporting that window with a rigid foraminous reinforcing member. Similarly, U.S. Pat. No. 3,611,418 to Uno discloses a large window having a mesh-like supporting section.

An object of the present invention is to provide an electron beam device having a broad beam.

Another object of the present invention is to provide an electron beam device that is capable of easy repair after a hole has developed in an electron window.

SUMMARY OF THE INVENTION

The above objects are met by an electron beam device having an array of individual, electron permeable, gas impermeable windows. The windows are generally thin but can have areas of various sizes and shapes and are disposed at a front end of a vacuum tube having electron generation and acceleration means. The array can be arranged as needed to suit the particular application of the device. In this manner, the total window area of the device can be quite large without failure of the windows due to the pressure difference created by the vacuum, allowing for devices that produce a broad beam of electrons.

The use of a plurality of individual windows has a number of other advantages. First, since each window is relatively small, each window can be more easily formed free of defects. Specifically, the windows can be formed as single crystal films, which have advantages in strength, electron permeability and gas impermeability. Such single crystal films can be prohibitively difficult to produce as a single large window. Second, failure of one of the windows does not necessarily impair the entire device. Depending upon the application, a window that has developed a pin hole may simply have the hole plugged with a sealant such as epoxy, and the tube re-evacuated.

The use of multiple windows also allows an electron generating vacuum tube to have a variety of shapes, as the electron emission area of that tube is not constrained by working with a single window.

To cause electrons to traverse an array of windows, an electron beam scans across the array in a sequence controlled by a microprocessor. A current monitor connected to a face plate that houses the array provides feedback as to the accuracy with which the electron beam is traversing the windows rather than impinging upon the face plate, the feedback used by the microprocessor adjusts the intensity or direction of the beam while scanning the array or during a subsequent scan.

BEST MODE FOR CARRYING OUT THE INVENTION

Figure 1:
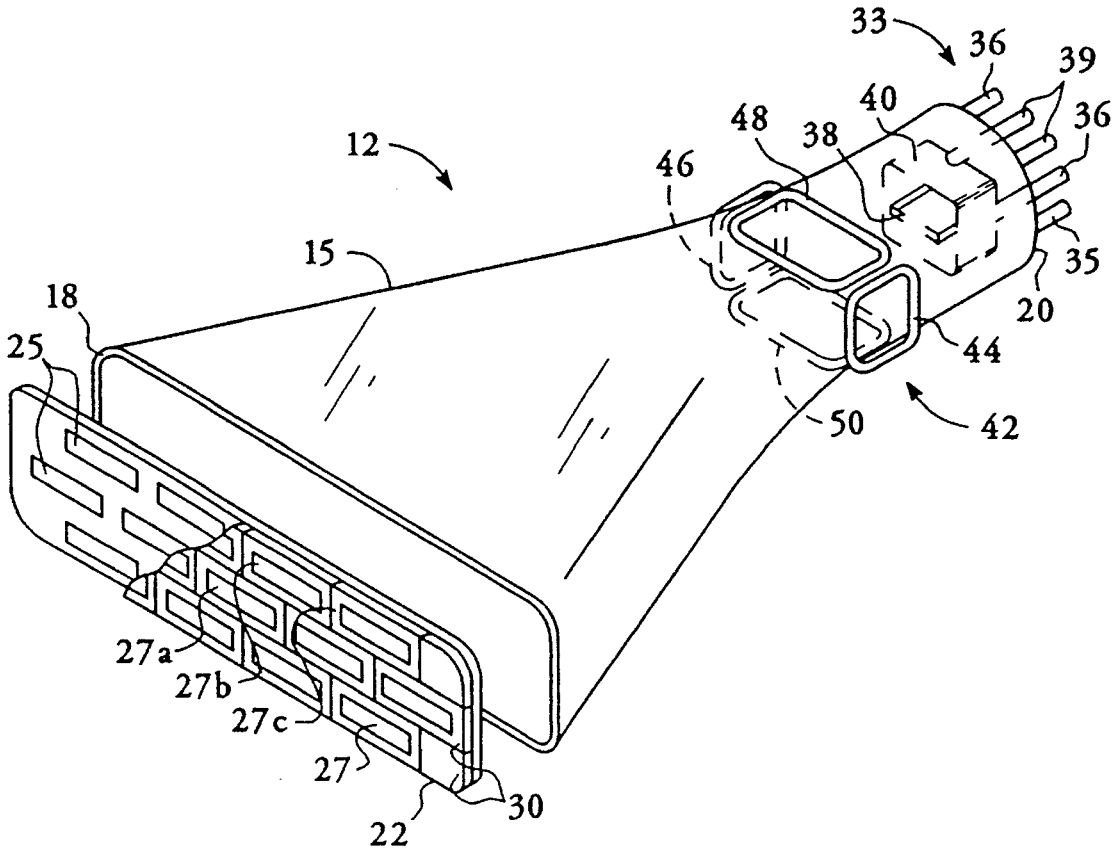
FIG. 1 is a perspective view of a multiple window device of the present invention.

Referring now to FIG. 1, an electron beam device 12, including a gas impermeable envelope 15, is shown having a front end 18 and a back end 20. A face plate 22 is shown in this perspective view removed from the front end 18 of the envelope 15, as it would be during manufacture. The face plate 22 may be formed of silicon, glass, ceramics, metals or other gas impermeable materials having a similar coefficient of thermal expansion as a material, such as silicon, used to make windows. The face plate 22 has an array of rectangular apertures 25. The apertures 25 can be produced by molding, etching or other techniques. A plurality of thin, electron permeable, gas impermeable windows 27 are attached to window segments 30 and cover the apertures 25.

In a preferred embodiment, the window segments 30 are formed from single crystal silicon wafers. The windows 27 may be produced, for example, by anisotropic etching of a rectangular central area of silicon window segments 30 in exact amounts, so as to leave a thin window 27 in that center. The window segments 30 are individually produced to avoid defects during production or cracking during handling that tends to occur with larger blocks of silicon. The window segments 30 are then bonded to the face plate 22 with anodic bonding or other techniques. The face plate 22 with the window segments 30 attached is then similarly bonded to the front end 18 of the envelope 15.

In order to reduce damage to the windows 27 during handling or operation, the windows 27 may be slightly compressed prior to evacuation of the envelope 15. This compression may be achieved, for example, by ion implantation in the window area that results in a slight mechanical expansion of the window 27.

The back end 20 of the envelope 15 has a number of pins 33 protruding therefrom, of which only a few are visible in this figure. The pins 33 provide various electrical connections to an interior of the envelope 15, and also offer support for the envelope 15. One of the pins 33 is an evacuation tube 35 that can be connected to a pump for evacuating the envelope 15 of gases and then sealed to prevent gases from reentering the envelope 15. Another pair of the pins 33 are electrical connectors 36 for a filament 38 disposed within the envelope 12. The filament 38 is generally staple-shaped and generates free electrons by thermionic emission when provided with a current through the pair of connectors 36. Another pair of the pins 33 are electrical connections 39 for a cathode 40 disposed within the envelope 12. The cathode 40 generally surrounds the filament 38 on all sides except for a side facing the front end 18 and except for a pair of holes facing the back end 20 through which the filament connectors 36 extend. The cathode 40 can be brought to a large negative voltage for accelerating the electrons from the filament toward the front end 18, which is maintained at approximately ground voltage. Due to the staple-shaped filament 38 and the generally box-shaped cathode 40, electrons emitted from the filament 38 are focussed and accelerated by the cathode 40 into a stripe-shaped beam traveling toward the front end 18.

As the stripe-shaped beam is accelerated toward the front end, it is deflected by a yoke 42 which directs the beam to one of the windows 27. The yoke 42 is comprised of four electrically conductive coils that are spaced in a circle around a neck of the envelope between the front end 18 and the back end 20. Each of the coils has an axis oriented generally normal to and intersecting a longitudinal axis of the envelope 15, the coils arranged as a pair of coils sharing a vertical axis and a pair of coils sharing a horizontal axis. The coils each generate a magnetic field proportional to an electric current flowing through each coil and directed essentially along the respective axis of that coil. The magnetic fields produce forces on traveling electrons that are vector cross products of an electron velocity and a magnetic field vector.

A vertical position of the beam is determined by a magnetic field lines directed generally horizontally within the envelope 15 which are generated by an electrical current in a left coil 44 and a right coil 46. A horizontal position of the beam is determined by magnetic field lines that run generally vertically within the envelope 15 and are caused by electrical currents flowing around an upper coil 48 and a lower coil 50. Each coil 44, 46, 48 and 50 is provided with electrical current through a separate pair of leads, which are not shown in order to facilitate illustration of other elements. It is also possible to provide horizontal and vertical deflection to the electron beam by means of horizontal and vertical deflecting plates, not shown.

In order for the beam to pass through each of the windows 27 on the face plate 22, the currents and voltages in the filament 38, the cathode 40, the right coil 44, the left coil 46, the upper coil 48, and the lower coil 50 can be synchronously varied in discrete steps. For example, the filament 38 can first be pulsed with current in order to create a swarm of free electrons adjacent to the filament 38. Simultaneously, or at a short time thereafter, the cathode 40 can be pulsed with a high level of negative voltage, causing a packet of electrons to travel toward the front end 18. Based upon a calculated acceleration and velocity of that packet of electrons, a magnetic field can then be created by the coils of the yoke 42 in an amount required to deflect the wave packet to a selected window 27.

A second free electron packet is subsequently propelled toward the front end 18, and the currents in either the vertical axis or horizontal axis coils are varied by a discrete amount necessary to deflect this second wave packet to a window 27 adjacent to the window 27 that the first packet was deflected toward. The deflection strength of the magnetic fields diminishes sharply distal to the coils, so the pulses do not necessarily have to be spaced to allow a first packet to traverse a window before the fields are changed to deflect a second packet to an adjacent window. The deflection experienced by a front end of a packet should, however, be generally equal to that experienced by a back end of a packet, in order to direct the packet through an individual window.

Figure 2A:
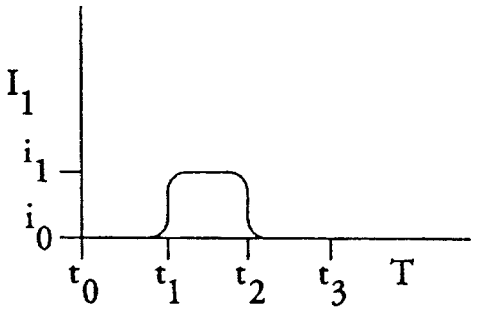
FIGS. 2A and 2B are plots of the electrical current flowing in deflecting coils of the invention of FIG. 1.
Figure 2B:
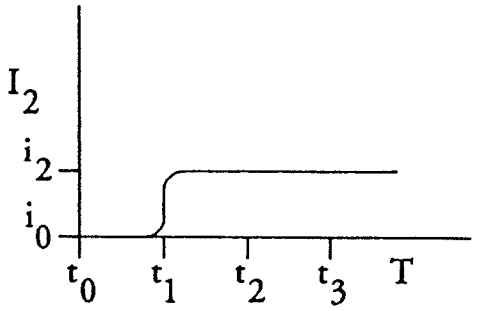

FIG. 2*a* shows a plot of an electrical current ($I_1$) flowing in the both the right coil 44 and the left coil 46 as a function of time (T), while FIG. 2*b* is a plot of the electrical current ($I_2$) flowing in both the upper coil 48 and the lower coil 50 at the same time (T). Due to the cross product nature of the magnetic force, the current $I_1$ in coils 44 and 46 determines the vertical deflection of electrons traveling in the envelope 15 toward the front end 18, while the current $I_2$ in coils 48 and 50 determines the horizontal deflection of those electrons. At $t_0$, the current $i_0$ is zero in all the coils 44, 46, 48 and 50, so that an electron packet traveling toward the front end 18 is not deflected, and thus traverses a center window 27*a* of FIG. 1. At a time $t_1>T>t_2$, the current $I_1$ in coils 44 and 46 has been increased to a level $i_1$, while the current $I_2$ in the coils 48 and 50 increases to $i_2$, and thus a second electron packet which is traveling through the yoke 42 at time $t_1>T>t_2$ is deflected to window 27*b*. At time $t_2>T>t_3$, the current $I_1$ drops to zero while the current in $I_2$ has been raised to $i_3$, so that the next electron packet is deflected to traverse window 27*c*. Continuing in this manner, all of the windows 27 can be traversed by electron beams.

The staggered array of windows 27 shown in FIG. 1 offers a contiguous horizontal electron beam treatment area to an object that is moving in a vertical direction relative to the device 12 and in front of the windows 27. Note also that different current sequences can be used to beam electrons through the windows in a different sequence. For example, a particular application may require only that a row of windows is used for electron transmission. In this case a center row may be chosen, and the current $I_1$ may be remain at zero, while the current $I_2$ varies in steps to cause the beam packets to sweep horizontally across the face plate 22. In this situation, should a window 27 develop a pinhole, that pinhole may be sealed with epoxy or another sealant, and that window may thereafter be avoided by the sweep by deflecting a beam packet instead to a window 27 in an adjoining row.

Creating a broad beam electron device 12 from a number of small windows 27 allows the windows 27 to be formed as single crystal films or membranes, which are difficult to grow and handle in larger sizes. Single crystal membranes have a number of advantages for electron permeable, gas impermeable windows for electron beam devices. The orderly crystalline lattice of such single crystal membranes permits electrons to more easily penetrate the membranes, allowing a lower voltage to be applied between the cathode 40 and the face plate 22 and lower energy electrons to be produced. At the same time, the orderly crystalline lattice of such membranes better prevents gas or liquid molecules from penetrating the membranes. The strength of single crystals is also superlative, allowing membranes formed of such materials to be made thinner, allowing even greater electron transparency. Such single crystals are also typically formed of elements having a relatively low atomic number, which reduces scattering of electrons traversing the membrane. The use of single crystal membranes for electron windows 27 in a beam generating device 12 thus has a combination of attributes not found in other types of windows 27, and which is facilitated by the multiple window 27 devices 12 of the present invention.

A single crystal membrane can be fashioned by selectively etching a single crystal substrate to leave a window 27 of desired dimensions within a window segment 30. Alternatively, a single crystal membrane can be grown on a crystalline substrate having a matching lattice constant which promotes single crystal growth, after which the portion of the substrate obstructing the window is etched away. In either of these embodiments, the remaining substrate, termed a "single crystal film" can serve as a window segment 30 for attachment of the membrane to the remainder of the vacuum tube device 12.

Figure 3A:
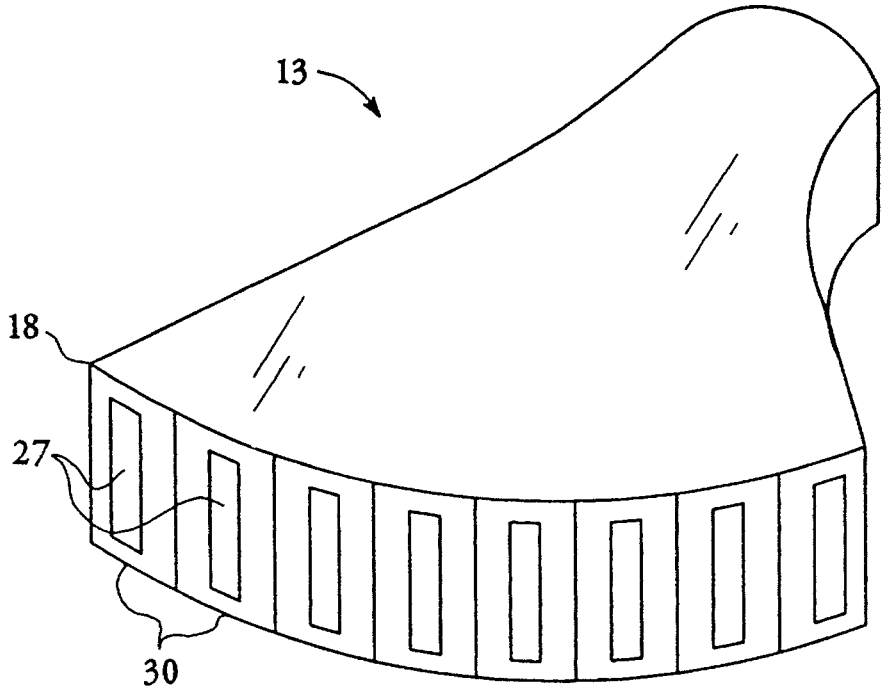
FIG. 3*a* is a perspective view of an embodiment of the present invention having an arcuate front end.
Figure 3B:
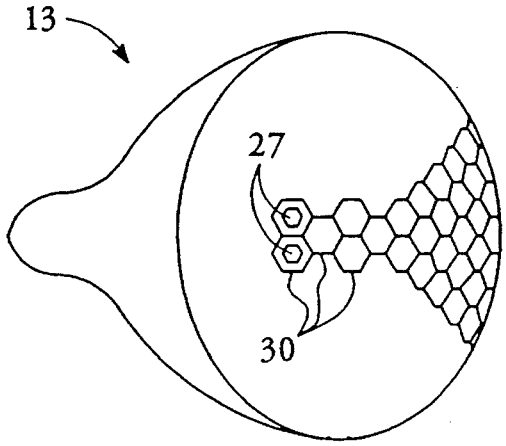
FIG. 3*b* is a perspective view of an embodiment of the present invention having a semispherical front end.
Figure 3C:
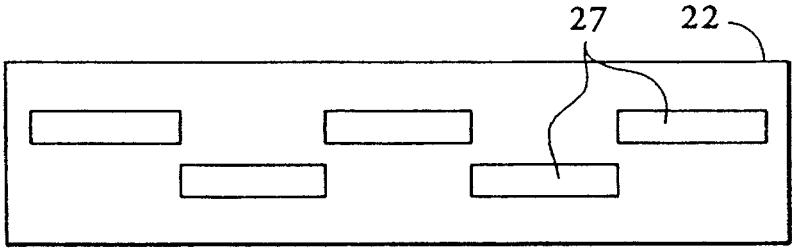
FIG. 3*c* is a front view of a face plate of the present invention having two rows of staggered windows.

Referring now to FIGS. 3A and 3B, the use of multiple window segments 30 in an electron gun allows the front end of the gun to have shapes that are difficult, if not impossible, to achieve with a single window. FIG. 3*a* shows a device 13 with an arcuate front end, which is useful for certain applications. The individual windows 27 may be essentially planar, and can be formed of single crystals. Similarly, FIG. 3*b* shows a device 14 with a number of hexagonal window segments 30 housing a number of hexagonal windows 27. In this device 14, the front end 18 is hemispherically shaped, another structure which is difficult to produce with a single window. Although not shown, windows 27 can be formed having a variety of other polygonal shapes, with areas that are triangular or pentagonal, for example. Circular, elliptic and oblong window areas are also possible for multiple window electron guns. FIG. 3*c* shows a planar face plate 22 having two rows of windows 27 that are alternately spaced. This embodiment allows a broad electron beam to be produced, but due to the segmentation provided by the individual windows 27, each window 27 can be a single crystal film or can be made thinner without failing under stress from the vacuum that would wreck a single window similar in area to the combined areas of the individual windows 27.

Should a pinhole develop in any of the windows 27, a high electrical current is observed flowing to the cathode 40 through the connections 39, as shown in FIG. 1. This is due to gases entering the envelope 15 being ionized by the highly negative potential of the cathode 40 and providing a path for current flow from the cathode 40. A current sensing circuit, not shown, can be connected to connections 39 and to a power supply, also not shown, in order to shut off the voltage and current to the cathode 40, filament 38, and coils 44, 46, 48 and 50, in the event of a high current flow through connectors 39.

With the power to the device off, the pinhole can be located and sealed. Locating the pinhole can be accomplished by inspection or with a pressure sensitive transducer disposed to create a sealed chamber outside each window segment 30, and using the evacuation tube 36 to create a vacuum within the envelope 15 which is felt by the transducer only at the window with a pinhole. Similarly, a thin plastic foil can be placed as a cover outside all the window segments 30 and the envelope evacuated by the tube 36 while watching for displacement of the foil outside an individual window 27 as evidence of a pinhole at that window 27.

Once the pinhole is located, it is sealed with epoxy or another sealant. The sealed envelope 15 is then evacuated of gases, and the device 12 can again be employed for generating electrons. Depending upon the application of the device 12 and the type of sealant used, the electrons may be focused to avoid the window 27 having a sealed hole. For applications in which the window 27 having the sealed hole is to be penetrated with electrons again, the sealant can be selected and applied so that it is permeable to electrons.

Figure 4:
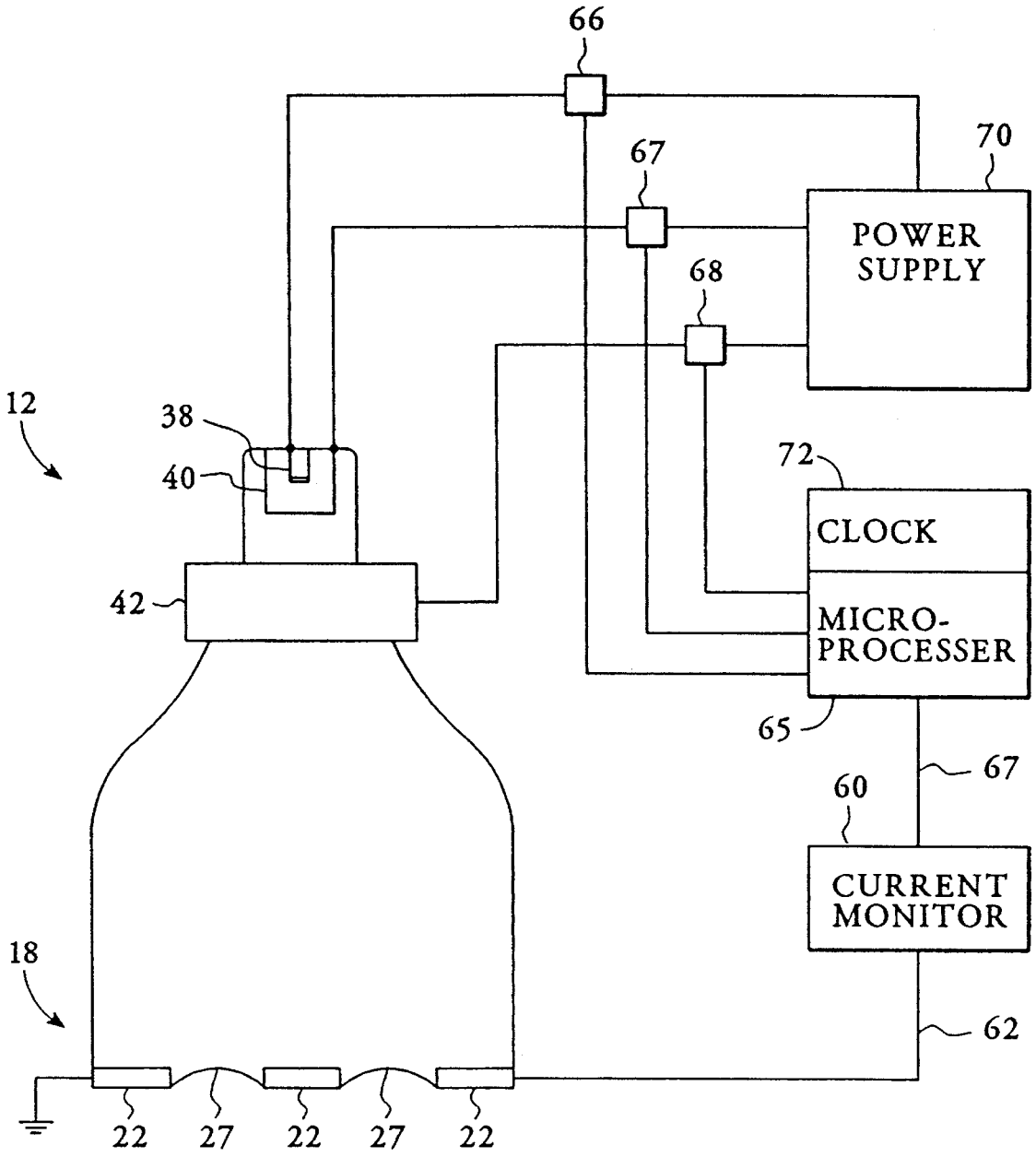
FIG. 4 is a diagram of electronic controls employed in the device of FIG. 1.

Referring now to FIG. 4, electronic controls for an electron beam device 12 having multiple windows 27 include a current monitor 60 such as an ammeter, having an electrical lead 62 connected to an electrically conductive face plate 22. The current detected by the monitor 60 can be used to determine various characteristics of the electron beam as it traverses the front end 18. For example, if the current detected by the monitor 60 is a large proportion of the current of the beam, it is likely that the beam is not passing through the windows 27 but rather impinging upon the face plate 22, which is preferably made of a metal such as aluminum that is thicker than the windows 27 and absorbs more of the beam current, conducting that current through lead 62 to monitor 60.

A signal from the current monitor 60 that indicates the current detected from the face plate 22 is sent to a microprocessor 65 via line 63. Note that the current monitor 60 can actually be formed of circuits within the microprocessor 65, but the monitor 60 is shown separately for ease of depiction and description. The microprocessor 65 controls a power supply 70 that provides current and voltage to the filament 38, cathode 40 and yoke 42, via switches 66, 67 and 68, respectively. Note that the yoke 42 is actually comprised of coils 44, 46, 48, and 50, not shown in this figure for ease of illustration, which are separately controlled by several switches, also not shown, rather than the single switch 68 shown controlling the yoke. The microprocessor has a memory and a clock, 72, for controlling the voltages and currents supplied to the filament 38, cathode 40 and yoke 42 to cause the beam to sweep across the front end 18 in pulses that traverse the windows 27 without hitting the face plate 22. This control function can be programmed in the microprocessor 65 and can be changed, for example, to provide different sweeps of the beam for different applications of the device 12 or to avoid a window 27 that has been damaged.

In combination with the current monitor 60, the microprocessor 65 can increase the accuracy with which the beam impinges upon the windows 27 but not the face plate 22, by using the signals from the current monitor to control pulsing of the beam. For instance, if a high proportion of beam current is detected at the current monitor 60, indicating that the beam is striking the face plate 22 rather than a window 27, and this information is fed to the microprocessor 65, the microprocessor 65 may be programmed to decrease the voltage and current from the power supply 70 to the filament 38 and cathode 40, thereby decreasing the current of the beam. Electrons in the beam and the electronic circuitry travel so much faster than the speed that the beam sweeps across the front end 18 that this feedback mechanism, to a first approximation, acts to control the beam current at the position of the beam detected by the monitor 60. The microprocessor 65 can also store information in its memory regarding beam current detected by the monitor 65 at a certain time during one sweep that is used to control beam current at that time during a subsequent sweep, in order to more accurately control beam position. Instead of or in addition to controlling the power to the filament 38 and cathode 40 in order increase the accuracy of the beam pulses in striking the windows 27, the currents provided to the coils 44, 46, 48 and 50 of the yoke 42 can be varied by the microprocessor 65 in order to better direct the beam through the windows 27.

In order to provide a feedback signal to the current monitor 60 to correct for a converse situation in which the beam does not have a high current when impinging upon a window 27, the beam can have a low or residual current when it is intended to strike the face plate 22 as well as a high current when it is intended to strike a window 27. The beam current in the high state may be on the order of a milliampere while that of the low state may be on the order of a microampere, so that the high and low beam currents differ by a factor of a thousand. Thus the current detected by the monitor 60 may have one of four essentially discrete values which depend on the beam current and the location of impingement of the beam at the front end. A first value, termed "high-pass" occurs when a high beam current passes through a window 27, the small fraction of the beam current that is absorbed by the window 27 being detected by the monitor 60. A second current value detected at the monitor 60 is dubbed "high-stop", and corresponds to the situation in which a high beam current impinges upon the face plate 22, thereby resulting in a relatively large amount of current detected at the monitor 60 A third value, termed "low-pass", occurs when a low beam current passes through a window 27, so that only a small fraction of that low beam current is absorbed by the window and detected by the monitor 60. A fourth value, termed "low-stop", occurs when the low beam current impinges upon the face plate 22. Generally the low-pass and high-stop signals are minimized by controls of the microprocessor 65, while the high-pass and low-stop signals are encouraged by the microprocessor 65.

Although not shown in this figure, the microprocessor may control electron beam intensities and directions for a number of such devices 12, and may receive input from current monitors 65 associated with each of the individual devices 12. Note also that the microprocessor 65 can configure the intensity and direction of the electron beam scan to fit an arrangement of windows, without initial instructions being provided to the microprocessor 65 regarding the arrangement of the windows.

I claim:

1. An electron beam device comprising, an evacuated gas impermeable envelope having a back end and a front end, a first and second array each comprising of a plurality of electron permeable, gas impermeable windows disposed at said front end in horizontal rows and vertical columns, with the rows and columns of the first array being staggered with respect to the rows and columns of the second array, with at least one window from the first array extending so as to overlap two adjacent windows of said second array and at least one window from the second array extending so as to overlap two adjacent windows of said first array, filament means for generating electrons within said envelope, means for accelerating said electrons along a direction from said back end to said front end, deflection means for deflecting said electrons transversely to said direction, directing said electrons to impinge primarily upon said plurality of windows, said accelerating means and said deflecting means defining a trajectory means, means for focusing said electrons upon said plurality of windows, and timing means for synchronizing said trajectory means and said focusing means such that said electrons traverse at least two of said plurality of windows in a sequence of pulses.

2. The device of claim 1 wherein most of said windows have generally rectangular areas upon which said electrons are focused.

3. The device of claim 1 wherein most of said windows have generally polygonal areas upon which said electrons are focused.

4. The device of claim 1 wherein most of said windows have generally elliptical areas upon which said electrons are focused.

5. The device of claim 1 wherein said front end is generally planar.

6. The device of claim 1 wherein said front end is generally arcuate.

7. The device of claim 1 wherein said front end is generally elongated transversely to an axis connecting said front end and said back end.

8. The device of claim 1 wherein said windows are held in compression at said front end.

9. The device of claim 1 further comprising measurement means for detecting a location of said front end upon which said electrons impinge.

10. The device of claim 9 further comprising control means for impinging said electrons upon said windows in a sequence, said control means in electrical communication with said measurement means.

11. The device of claim 1 further comprising measurement means, in electrical communication with said timing means, for detecting a location of said front end upon which said electrons impinge.

12. The device of claim 1 wherein most of said windows are single crystal films.

13. A method for producing free electrons comprising, providing a vacuum tube having a front end and means for electron generation and acceleration, including forming a plurality of openings at said front end of said tube toward which electrons are to be accelerated and attaching a plurality of electron permeable windows to said end such that said openings are covered with said windows, evacuating gases from said tube, generating a plurality of electrons and accelerating said electrons toward said windows, monitoring said windows for defects, deflecting said electrons to avoid impinging upon a window having a defect.

14. The method of claim 13 further comprising deflecting said electrons toward a sequence of said windows.

15. The method of claim 14 further comprising gathering information regarding a location of said front end where said electrons impinge and controlling said accelerating and deflecting based in part upon said information.

16. The method of claim 18 wherein said defect is a hole and further including the step of monitoring said plurality of windows for holes in said windows, including locating a position of a hole in a window.

17. The method of claim 13 further comprising forming said windows by epitaxial growth of a thin film.

18. The method of claim 17 wherein forming said windows comprises epitaxial growth of a single crystal film spanning a window.

19. The method of claim 13 wherein said attaching said windows at said end such that said openings are covered with said windows includes attaching said windows in compression across said openings.

* * * * *